US005543882A

United States Patent [19]

Pagano et al.

[11] Patent Number: 5,543,882

[45] Date of Patent: Aug. 6, 1996

[54] METHOD AND APPARATUS FOR PROCESSING PHOTOSENSITIVE FILM

[75] Inventors: Daniel M. Pagano, Henrietta; Richard B. Wheeler, Webster; Kevin J. Klees, Rochester, all of N.Y.

[73] Assignee: Eastman Kodak Company, Rochester, N.Y.

[21] Appl. No.: 330,271

[22] Filed: Oct. 27, 1994

[51] Int. Cl.[6] ..... G03D 17/00

[52] U.S. Cl. ..... 354/311; 354/313; 354/321; 354/322

[58] Field of Search ..... 354/298, 310–315, 354/319–324, 88; 355/27–29; 134/64 P, 64 R, 122 P, 122 R

[56] References Cited

U.S. PATENT DOCUMENTS

| | | | |
|---|---|---|---|
| 2,112,605 | 3/1938 | Pless | 354/313 |
| 2,498,477 | 2/1950 | Alk | 354/310 |
| 2,562,877 | 8/1951 | Balluff | 354/310 |
| 2,595,898 | 5/1952 | Siedenburg | 242/602.3 |
| 2,692,541 | 10/1954 | Lesjak | 354/310 |
| 2,710,727 | 6/1955 | Orowick | 242/609.4 |
| 3,492,932 | 2/1970 | Van Baerle | 354/322 X |
| 3,724,353 | 4/1973 | Holbert | 354/313 |
| 3,888,675 | 6/1975 | Corrigan | 354/88 X |
| 4,375,324 | 3/1983 | Holmes | 354/313 X |
| 4,410,257 | 10/1983 | Thebault | 354/313 |
| 4,834,306 | 5/1989 | Robertson et al. | 355/40 |
| 5,029,313 | 7/1991 | Robison et al. | 355/40 |
| 5,093,686 | 3/1992 | Shigaki | 355/77 |
| 5,231,439 | 7/1993 | Takahashi et al. | 354/320 X |

*Primary Examiner*—D. Rutledge
*Attorney, Agent, or Firm*—Frank Pincelli

[57] ABSTRACT

A method and apparatus for processing of filmstrip contained in a film cartridge. The apparatus having at least one processing tank for holding a processing solution, a holding mechanism for holding and retaining a film cartridge containing a filmstrip having a leading edge and trailing edge, the trailing edge being secured to the cartridge, a transport mechanism for moving the holding mechanism along the apparatus so that the holding mechanism can be located at a workstation located at one of said at least one processing tank, and a film drive mechanism for moving the film out of or back into the film cartridge while the end of the film is still attached to the cartridge.

17 Claims, 9 Drawing Sheets

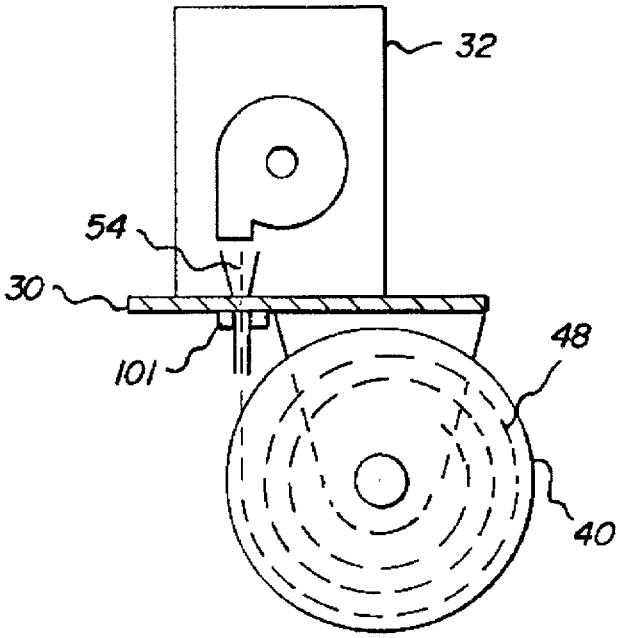
Fig. 8
Fig. 9
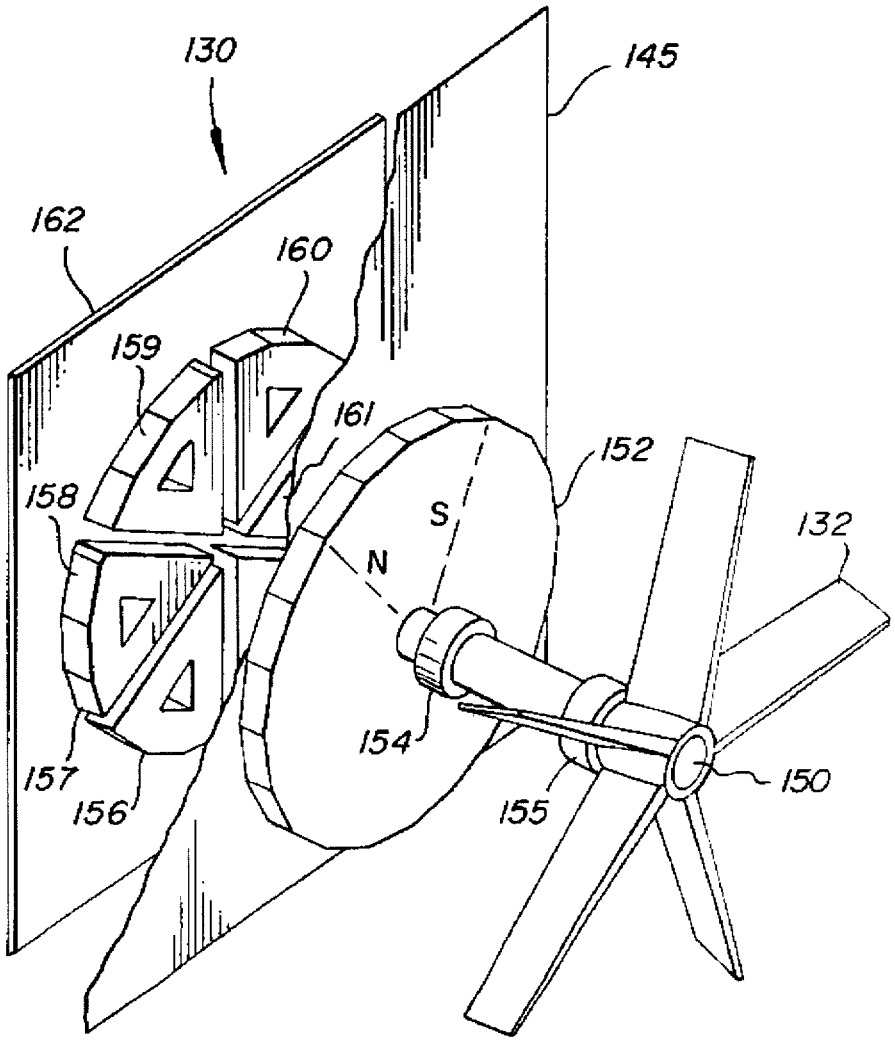

METHOD AND APPARATUS FOR PROCESSING PHOTOSENSITIVE FILM

FIELD OF THE INVENTION

The present invention relates to the processing of photosensitive material and more particularly to a method and apparatus for processing photosensitive film while the film is still attached to the film cartridge.

BACKGROUND OF THE INVENTION

Traditional methods for processing photosensitive film contained in cartridges typically involves the separation of the filmstrip from the cartridge prior to processing. In one method, the photographic film is cut away from the cartridge, and taped to a leader board or a length of flexible film, after which the film is drawn through a series of tanks containing the required processing solutions. This method has satisfied the reliability and efficiency requirements for the traditional photofinishing systems, largely due to the fact that the film cartridge is discarded and thus no longer serves any other purposes in subsequent stages of image preparation, storage and retrieval.

Recent advances in film cartridges, such as described in U.S. Pat. No. 4,834,306, disclose a photographic film cartridge wherein the filmstrip may be thrust out of the cartridge, and retracted back into the cartridge a number of times (hereinafter referred to as thrust film cartridge). For example, the thrust film cartridge can be used as a primary storage for the processed film, and can be used with related film handling equipment which can be configured to accept the thrust-type film cartridge. The ability to execute other tasks involved in the preparation, storage and retrieval of images from a specific filmstrip cartridge is advantageous to the photographer and to the photofinisher. In particular, the method of identifying, sorting, and preferentially reproducing (e.g., selecting desired print parameters; such as frame number, size, quantity, setup, and balancing data) images may be significantly enhanced. It has been proposed that the thrusting filmstrip be detached from the thrust film cartridge prior to chemical processing and processed in the traditional photofinishing equipment and then reattached to the original film cartridge (or similar cartridge) for storage.

The detached method exhibits a number of inherent disadvantages. Specifically, the correct filmstrip and cartridge must be reunited; detaching and reattaching the filmstrip can result in damage to the leader and/or trailing edge of the film which then must be cut and reshaped which adds cost to the process; reattaching of the film can be difficult and require certain standardized equipment. Additionally, the detached system cannot take advantage of the fact that only partial portions of the film may be exposed and developed without exposing the remaining portion of the film in the cartridge.

U.S. Pat. No. 5,093,686 discloses the processing of photosensitive material while the filmstrip is still connected to the film cartridge. This is accomplished by thrusting the film out of the cartridge and dipping the filmstrip into successive tanks, typically referred to as the dip and dunk process. The device includes a vertical transport mechanism for lifting the film up to a horizontal transport position where the film can then be moved horizontally while the film is still extended from the cartridge. This type of process results in the images at the bottom end of the strip to experience more development time than the portions above. Additionally, further expensive equipment is required to move and transport the film through the system.

Applicants have invented a unique processor which processes the film while still attached to the cartridge that solves many of the problems associated with prior art processors.

SUMMARY OF THE INVENTION

In one aspect of the present invention there is provided an apparatus for processing of filmstrip contained in a film cartridge, said apparatus comprising:

at least one processing tank for holding a processing solution;

a holding mechanism for holding and retaining a film cartridge containing a filmstrip having a leading edge and trailing edge, the trailing edge being secured to the cartridge;

a transport mechanism for moving the holding mechanism along the apparatus so that the holding mechanism can be located at a workstation located at one of said at least one processing tank; and a film drive mechanism for moving the film out of or back into the film cartridge while the end of the film is still attached to the cartridge.

In accordance with another aspect of the present invention, there is provided a method for processing a filmstrip while the filmstrip is still attached to a film cartridge, comprising the steps of:

providing a thrust film cartridge having an exposed filmstrip therein, said filmstrip having a leading edge and trailing edge, the trailing edge being attached to the cartridge;

providing at least one processing tank containing a processing solution;

providing a holding mechanism for holding a film cartridge;

driving the filmstrip out of the cartridge and into a holding device while the trailing edge of the filmstrip is still attached to the cartridge;

providing a drive mechanism for moving the holding mechanism so that the holding device can be located in at least one processing tank;

transporting the film cartridge through the apparatus and positioning said holding device in said at least one of the tanks; and maintaining the filmstrip in the adjacent tank for a predetermined period of time and then returning the filmstrip back into the film cartridge.

DESCRIPTION OF THE DRAWINGS

FIG. 8 is an enlarged cross-sectional view of the cover and reel assembly as taken along the lines 8—8 of FIG. 6;

FIG. 9 is an enlarged view of the motor and agitation propeller attached to each of the processing tanks.

DETAILED DESCRIPTION OF THE DRAWINGS

Figure 1:
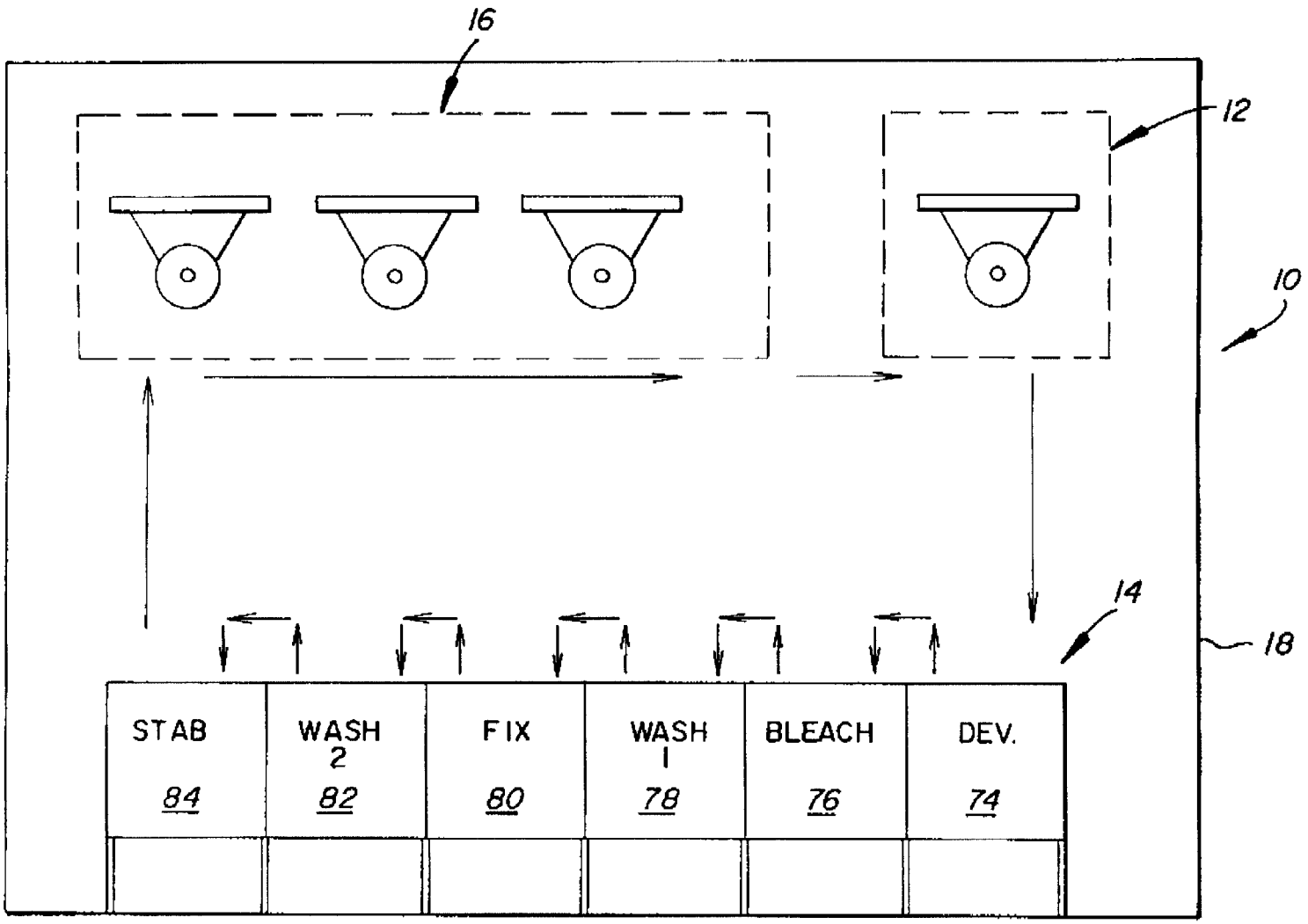
FIG. 1 is a diagrammatic representation of an apparatus made in accordance with the present invention.
Figure 2:
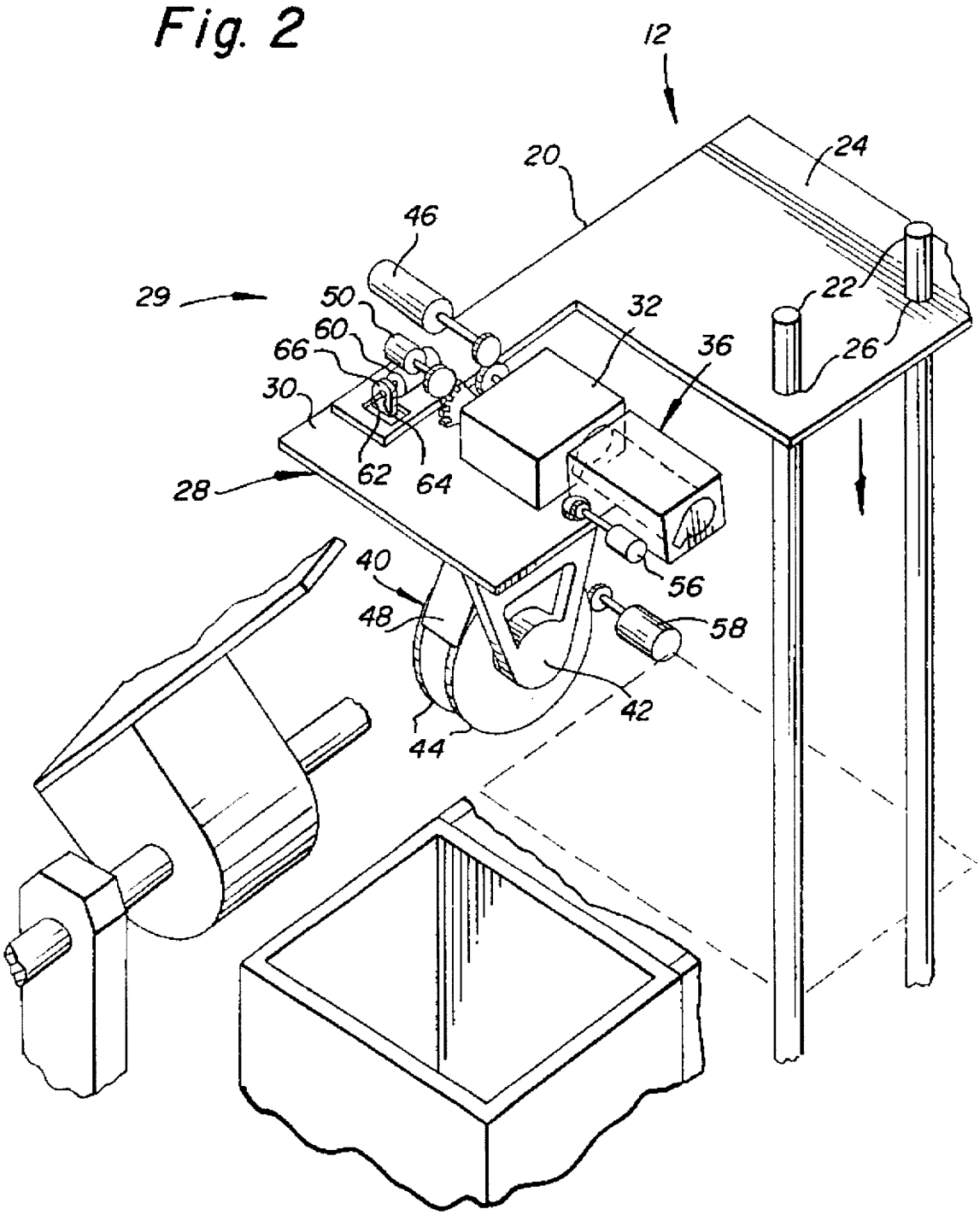
FIG. 2 is an enlarged partial perspective view of the load/unload station of the processor of FIG. 1 and a portion of the processing section.
Figure 3:
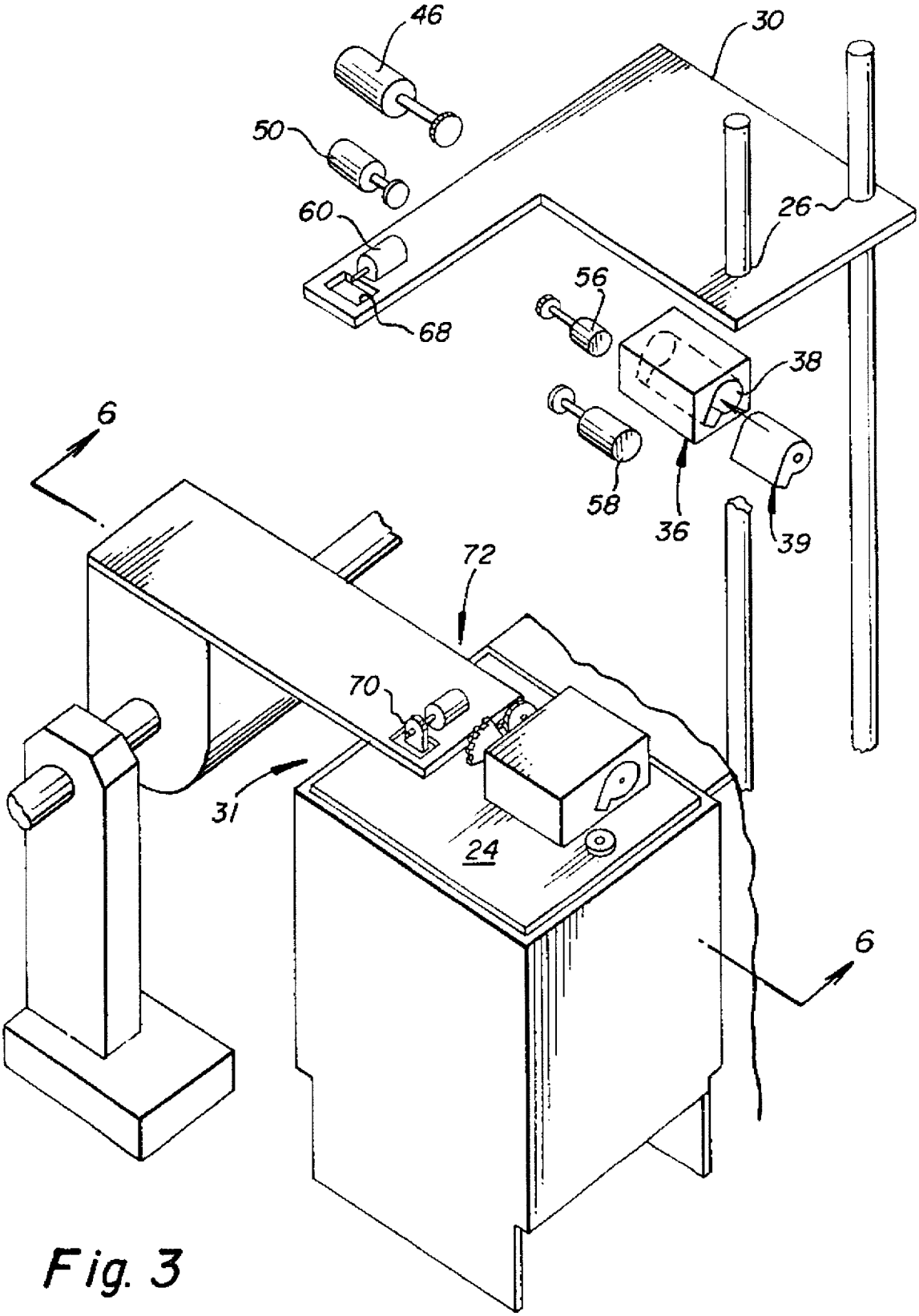
FIG. 3 is a view similar to FIG. 2 illustrating how film is wound from load/unload station through the processing system.

Referring to FIGS. 1–3, there is illustrated a processing apparatus 10 made in accordance with the present invention.

The apparatus 10 is designed to process photosensitive material, such as photographic film. In the particular embodiment illustrated, the apparatus is particularly adapted for processing photosensitive film that has been provided in a film thrust-type cartridges such as disclosed in U.S. Pat. No. 4,834,306, commonly assigned to the assignee of the present application and which is hereby incorporated by reference.

The apparatus 10 includes a load/unload station 12, a film processing section 14 and a drying section 16. As is typical with such processing apparatus, a housing 18 (see FIG. 6) is provided for containing the load/unload station, film processing section and drying section and for providing a light tight environment within the housing 18. Housing 18 is appropriately sized and configured so as to fully enclose the components and allow access as required.

At the load/unload station 12 photosensitive material is either placed into or removed from the apparatus 10. Referring to FIG. 2 there is illustrated the load/unload station in greater detail. In the particular embodiment illustrated the load/unload station 12 comprises an elevator 20 which includes a pair of vertical guide rods 22 and a lift support plate 24 having a pair of openings 26 through which the guide rods 22 extend. The guide rods 22 guide the support plate 24 through its vertical movement. An appropriate mechanism (not shown) is used to move the lift support plate 24 between the processing unload position 31 and the film cartridge load/unload position 29 as illustrated in FIG. 2. The processing unload position 31 is best seen in the lower portion of FIG. 3. The elevator 20 is designed to hold and engage a cover assembly 28 which is designed to receive a photosensitive material and take it through the photofinishing process. The cover assembly 28 includes a plate 30 which includes a film support member 32 designed to receive a thrust film cartridge 39 (see FIG. 3). The thrust film cartridge is of the type illustrated in U.S. Pat. No. 4,834,306 which is designed to be able to thrust the film out of the cartridge or back into the cartridge. The load/unload station 12 is provided with a cartridge feed mechanism 36 which is designed to receive film cartridges 39 into the processing apparatus 10 for processing and for dispensing of film cartridges 39 which contain film that have been processed. The cartridge feed mechanism 36 may be secured to the apparatus in any desired manner. For example, the cartridge feed mechanism 36 may be secured to the housing 18. An appropriate opening (not shown) would be provided in housing 18 allowing the film to be placed into or taken out of the mechanism 36. Film cartridge 39 is placed into mechanism 36 whereby the mechanism 36 which feeds the film cartridge 39 to the film support member 32 when a cover assembly 28 is positioned at the load/unload position 29 as illustrated in FIG. 2.

Figure 10:
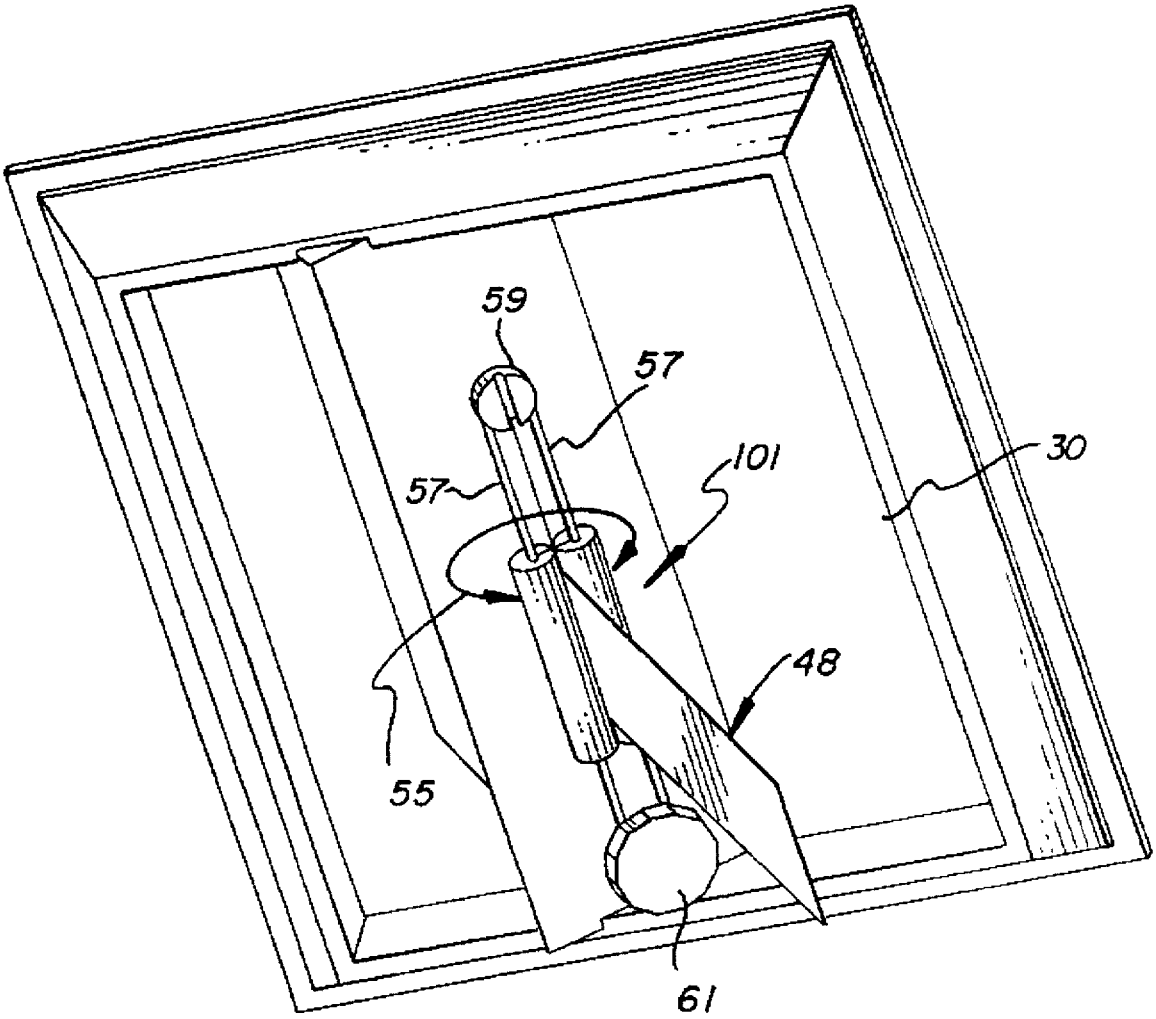
FIG. 10 is a bottom perspective view of the cover assembly with certain parts removed so as to illustrate the moisture seal.

The cover assembly 28 further includes a reel 40 and a reel support frame 42 which is secured to the bottom of support plate 30. Reel 40 includes a pair of spaced side members 44 spaced apart so as to receive the filmstrip that is thrust out of thrust film cartridge 39. The side members 44 are designed so as to provide a helical path about which the filmstrip travels. The helical path is such that the surface of the film will not touch the adjacent convolution as illustrated in FIG. 8. The side members 44 also hold the filmstrip in a stable generally fixed position. The reel 40 may take a variety of forms. In the particular embodiment illustrated, the reel is of the type described in commonly assigned U.S. Ser. No. 08/330,400, entitled AUTOMATIC PROCESSING REEL FOR USE IN PHOTOFINISHING, by Daniel M. Pagano and Kevin J. Klees, filed concurrently herewith, and which is incorporated by reference in its entirety. A cartridge film advance motor 46 is provided for thrusting the film 48 out of or returning the film back into the cartridge 39 positioned in film support member 32. A motor 50 is provided for opening and closing the door of the film cartridge 39 so as to allow the film to be thrust out of or back into the film cartridge 39. Plate 30 is provided with an opening 54 for allowing the film to exit the member 32 and wound onto reel 40. A moisture seal 101 (see FIG. 10) is secured to plate 30 and is constructed so that when cover assembly 28 is positioned at processing tank position 31 so as to minimize and/or eliminate the splashing of processing solution through opening 54. Referring to FIG. 10, moisture seal 101 comprises a pair of flexible rollers 55 which are normally biased against each other by a pair of spring members 57. The members at one end are secured to plate 30 by a screw 59 and at the other end by a rotating cam 61 which is also secured to plate 30. When it is desired to move film through opening 54, cam 61 is rotated 90° to separate rollers 55 so as to allow the filmstrip 48 to pass through without touching the roller 55. Once the filmstrip 48 has fully inserted into reel 40 or returned to cartridge 39, then the cam 61 is rotated 90° back to its original position to seal opening 54 as shown in FIG. 10. There is also provided a reel film advance motor 58 that oscillates one flange of reel 40 after the filmstrip has been advanced into reel 40 by motor 46 so as to feed the filmstrip onto reel 40. A solenoid 60 is provided for securing of the cover assembly 28 with respect to the lift support plate 24. A microprocessor (not shown) is also provided for controlling the appropriate activation or deactivation of the motors and solenoid at the appropriate time. The solenoid 60 moves projection 62 so that it can be inserted or removed from an opening 64 provided in mounting projection 66 disposed on the top of plate 30. The projection 62 passes through an opening 64 provided in tongue portion 70 of lift support plate 24. When the projection 62 engages opening 64, the support plate 30 is firmly secured in position with respect to the lift support plate 24 whereby allowing transportation of plate 30 from the load/unloading position 29 to the first processing position 72 illustrated in FIG. 3.

Referring to FIGS. 1, 4, 5, 6, and 7, there is illustrated in greater detail the processing section 14 which comprises a plurality of processing tanks 74,76,78,80,82,84. In the particular embodiment illustrated, processing tank 74 is a tank for holding developing solution; processing tank 76 is designed to hold a bleach processing solution; tank 78 is designed to hold a first washing solution; tank 80 is designed to hold a fixing solution; tank 82 is designed to hold a second washing solution; and tank 84 is designed to hold a stabilizing processing solution. It is to be understood that any desired number of processing tanks with the appropriate processing solution may be provided as required for that particular process.

The film processing station 14 includes a transportation mechanism for moving cover assembly 28 successively through the processing tanks 74,76,78,80,82,84. As can be seen, a plurality of cover assemblies 28 may be provided in the processor. The transport mechanism 86 consists of a pair of bearing mounts 88,89, linear bearing 90, a support bar 92, five independently activated solenoids 94 disposed on support bar 92. To lift one or more cover assemblies 28 out of a tank, the appropriate solenoids are activated so that the appropriate electrical state is provided to allow the projection 62 to engage the opening 64 of projection 66 of the associate cover assembly 28. To lift the cover assemblies 28 out of the processing tank, motor 98 is energizing rotating gear train 100, which in turn rotates gear 102 which is fixed to a drive shaft 104. Drive shaft 104 has two keys 106,108. The drive shaft 104 is rotated counter clockwise (see FIG. 7), key ways 106,108 which are in recess 110 of linear bearing 90 come into contact with edge 112 of linear bearing 90, and in turn rotate rack assembly and cover assembly counter clockwise lifting the reels 40 out of their respective processing tank. To move the cover assemblies 28 along the drive shaft 104, motor 114 and a pulley/syncromesh cable 116 are used. Motor 114 is mounted to one of three bearing blocks 118 via motor bracket 120. Bearing block 118 includes bearing 122, which supports drive shaft 104. Attached to the bearing mount 88 is collar 124. A ring 125 is trapped between bearing mount 88 and collar 124 and is allowed to freely rotate about collar 124. Syncromesh cable 116 is attached to ring 125 at point 127, around pulley 128, to and around a pulley point not shown which is a part of motor 114 and is fixed to ring 125 at point 129. As motor 114 is energized, syncromesh cable 116 moves the rack and cover assembly 28 axially in either direction to position the cover assemblies 28 over the next processing tank. Thus, it can be seen that the cover assemblies can be moved successively to each of the processing tanks 74,76,78,80,82,84.

After the cover assemblies 28 have gone through the processing section 14, the cover assembly 28 is taken therefrom by an appropriate elevator mechanism (not shown), such as described for moving the cover assembly from the load/unload position to the first processing station, to the drying section 16. The cover assembly 28 is appropriately moved through the drying section 16 at the appropriate speed, until the film is fully dried. The drying section 16 is maintained at the appropriate temperature. Thereafter the cover assembly 28 is successively placed at the load/unload station 29 where the film is rewound back into the thrust cartridge and the cartridge is ejected out of the processing apparatus 10.

Figure 6:
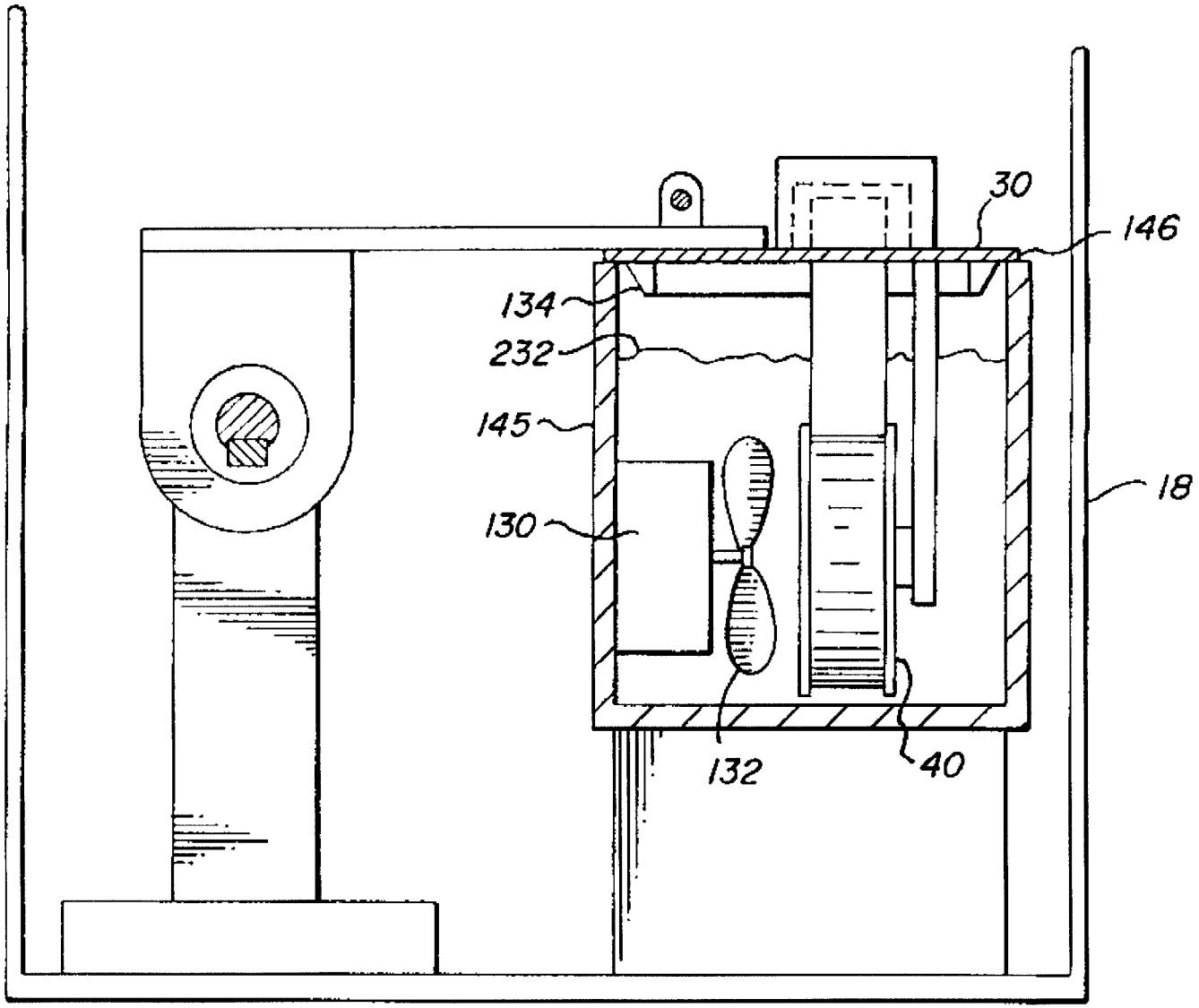
FIG. 6 is a cross-sectional view of one of the processing tanks illustrated in FIG. 3 as taken along line 6—6 within a housing.
Figure 7:
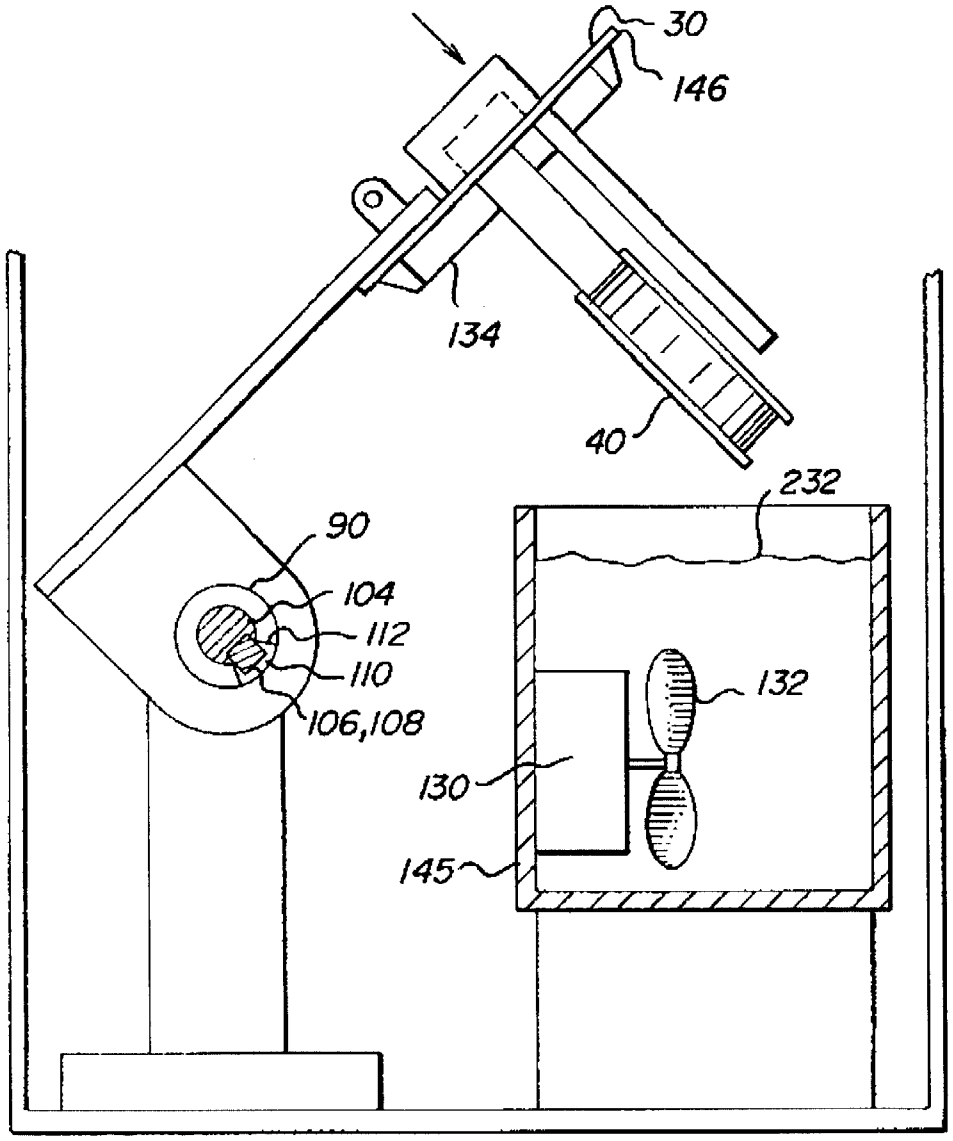
FIG. 7 is a view similar to FIG. 6 as taken along line 7—7 of FIG. 5.

Referring to FIG. 6, there is illustrated the reel 40 when it is fully submerged in the processing solution. Referring to FIG. 7, there is shown reel 40 when it is fully removed from the solution. As can be seen, there is provided means for agitating and passing the processing solution adjacent the surface of the film. In particular, there is provided a motor 130 having a propeller 132 for providing agitation and causing the processing solution 232 to pass through the reel such that the processing solution is continuously allowed to flow past the emulsion placed on the film. As can best be seen in FIG. 6, the cover plate 30 is provided with a ridge 134 around the periphery adjacent the upstanding wall 145 of the tank so as to minimize any potential splashing of the processing solution out of the tank. The plate 30 has an outer peripheral lip 146 which rests and mates with the upper end of the tank so as to provide a substantially sealed processing tank such that when the motor 130 is activated the processing solution will be maintained within the processing tank.

It is to be understood that propeller 132 may be driven through the use of a magnetic coupler, thus avoiding a rotating shaft passing through the tank wall. Referring now to FIG. 9, there is illustrated a modified agitation system employing a magnetic coupler, like numerals indicating like parts. In particular, there is provided a motor 130 and propeller 132 which is attached to shaft 150. At the other end of the shaft a flat circular permanent magnet 152 is provided. Magnet 152 has been magnetized so that a series of north south pole pairs exists around its circumference. Shaft 150 is supported by bearings 154,155. All of propeller 132, shaft 150, magnet 152, and bearings 154,155 are contained wholly inside the processing tanks 74,76,78,80,82,84. Coils 156–161 and printed circuit board 162 are placed outside of and in close proximity to tank wall 145. Tank wall 145 is comparatively thin at the location of coils 156–161 and has been shown cut away in this view. magnet 152 is placed in close proximity to the inside of tank wall 145 on the same radial axis as coils 156–161. Coils 156–161 are energized in a sequential fashion to generate a revolving electro-magnetic field. The north south pole pairs of magnet 152 will be attracted to this rotating field causing magnet 152, shaft 150, and propeller 132 to rotate within bearings 154,155. This technique of brushless DC motors is well known in the art and applied to compact disc players, for example. It is, of course, understood that any type magnetic coupling device may be employed.

Referring to FIG. 10 of the present application, moisture seal 101 comprising a pair of flexible rollers 55, engages the filmstrip after the exposed frames have been transferred to the processing reel. In the preferred partial-roll processing embodiment, the moisture seal is placed precisely between the last exposed film frame and the adjacent unexposed film frame so as to avoid wasting any unexposed film frames. However, if the film or processor configuration necessitates that the moisture seal intersects the imaging area of the next unexposed frame, the included magnetic read-write apparatus is activated and magnetic information indicating film exposure is written to the camera tracks on the frame where moisture seal clamping takes place. Consequently, when the film is loaded into the camera following partial-roll processing, the camera will advance the film past the processed frames and the frame containing the previous moisture seal engagement, and stop at the next unexposed frame.

Figure 4:
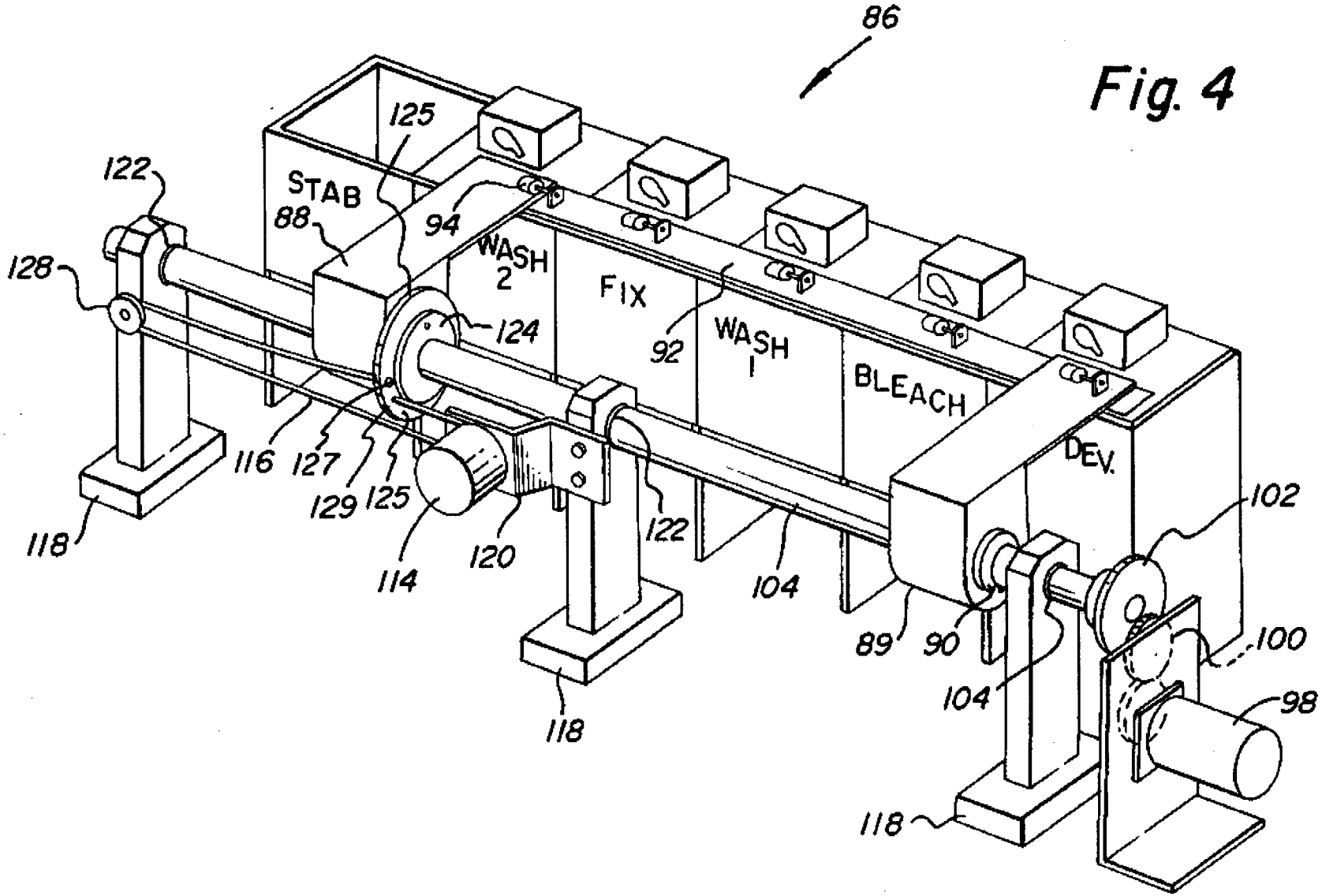
FIG. 4 is a perspective view of the processing section of the apparatus of FIG. 1.
Figure 5:
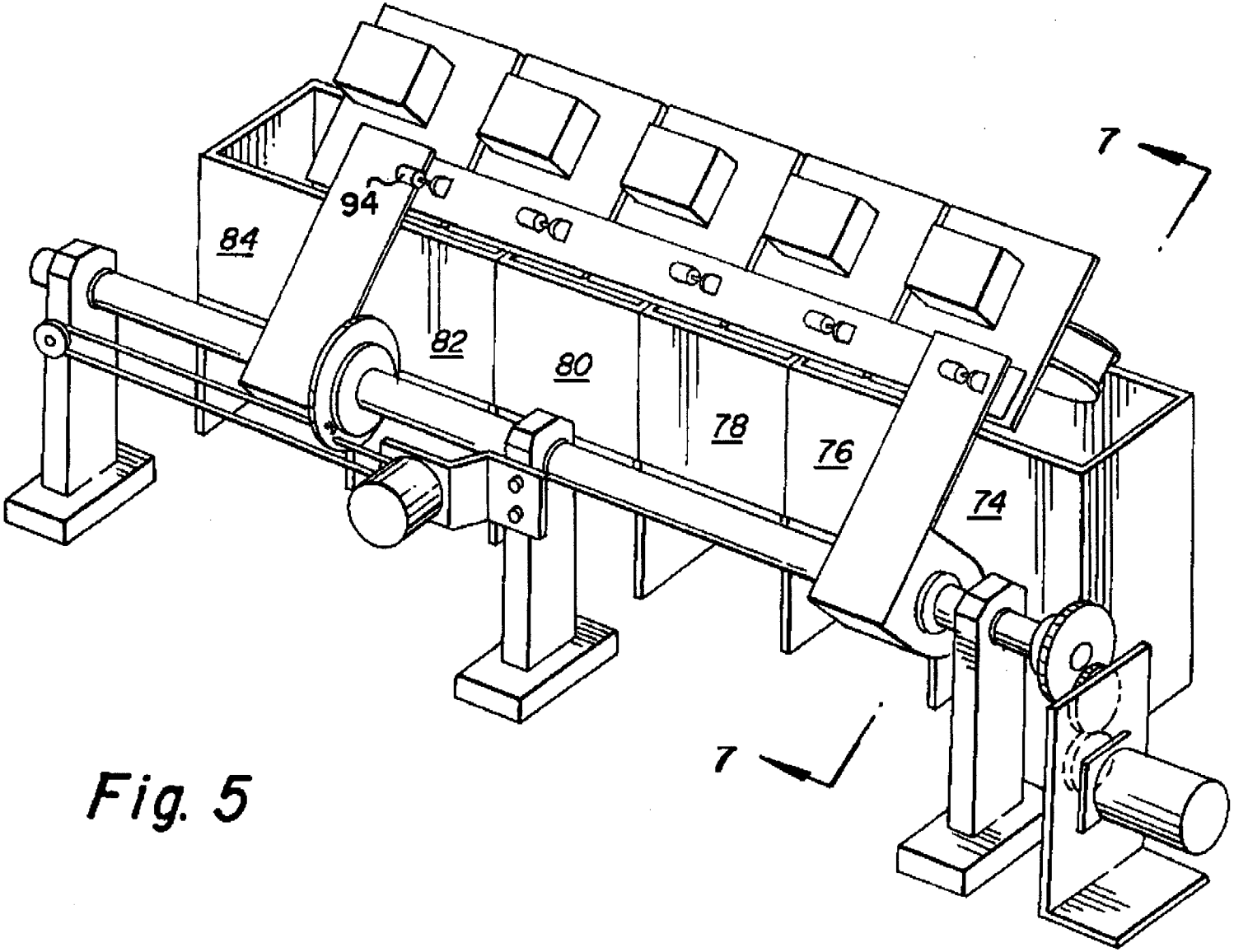
FIG. 5 is a view similar to FIG. 4 illustrating how the film is either placed into or removed from the respective processing bath.

In order to more clearly understand the present invention a brief description of its operation follows. Initially a thrust film cartridge 39 is provided to the cartridge film mechanism 36 through opening 38 whereby the cartridge 39 is then inserted into the film support member 32 at which time the motor 50 is actuated so as to open the film exit door on the film cartridge 39. Motor 56 is then activated so as to open moisture seal 101 on plate 30. Motor 46 is then activated so as to thrust the film out of the cartridge through moisture seal 101 and into the reel 40. After the film has been fully loaded onto the reel 40 the moisture seal 101 is closed and the elevator is moved to the first processing position 31 whereby solenoid 60 is deactivated so as to allow the cover to remain on processing tank 74. Thereafter, the elevator support plate 24 is moved to the load/unload position 29 where it will be in position to receive the next cover assembly 28 that is being processed from the dryer station 16. The transport mechanism is then placed in the appropriate position as illustrated by FIG. 4. The motor 130 in each of the processing tanks is activated so as to allow processing solution to be passed adjacent to the film. The film is maintained in each of the process tanks for the appropriate time period desired. After the time period has expired the transport mechanism is moved to position as illustrated in FIGS. 5 and 7 and the support bar 92 is moved along shaft 104 by the appropriate activation of motor 114. Thereafter, motor 98 is rotated in appropriate direction so as to place the cover assemblies 28 in the next appropriate processing tank. This process is repeated until end cover assembly 28 has passed through the last processing tank, which in the present application is tank 84. After the cover assembly 28 has been processed in tank 84 for the appropriate time period an appropriate lift mechanism, not shown, removes the cover assembly from tank 84 and transports it to the drying section 16 where the transport mechanism, or another mechanism transports the cover assembly through the dryer until it is appropriately dried whereby it is then transported to the load/unload station 12. Once the film has been brought back to the load/unload station 12 the film is then rewound back into the cartridge 39 and then ejected from the apparatus 10 whereby the film cartridge 39 can then be automatically transported or manually taken to an appropriate printer whereby photographic prints may be made.

As can be seen an apparatus made in accordance with the present invention can be operated in a fully automated manner without any manual operation other than to insert the cartridge into the apparatus. After development of the film the operator receives the film fully developed and in the original cartridge which it was supplied. Thus, the cartridge becomes the storage medium for the negative film. Additionally due to the fully automated nature of the apparatus, it can be incorporated into a fully automated processing and printing apparatus wherein an individual would bring film for developing and printing. Appropriate mechanisms can be provided for receiving customer information and payment. For example an keyboard could be provided for entry of information to a computer within the device which would be used to track the film during its development and printing, and for calculating the appropriate charge. Also a mechanism could be provided for receiving cash or credit card payment.

In the preferred embodiment illustrated, the mechanism for thrusting the film out of and back into the cartridge is provided only at a single location thus minimizing the amount of equipment needed for this purpose. However, an individual thrusting-out mechanism may be secured with the cover assembly 28 and thus allow the film to be thrust out or back into the cartridge at each station as desired.

In the preferred embodiment, the filmstrip is typically completely transferred such that the entire exposed filmstrip is disposed within the reel 40. However, if only a portion of the filmstrip has been exposed, only that portion need be thrust out for processing, leaving the remaining unexposed film for processing at a later date after it has been exposed. This avoids the necessity of wasting the remaining exposures when it is desired to quickly obtain prints quickly of the initial exposure obtained.

After processing only the exposed areas of the filmstrip (partial-roll processing), the filmstrip can be returned to the photographer's camera, at which time additional images may be added to unexposed areas of the filmstrip when the photographic desires that the additional images are to be developed, the above-mentioned partial-roll processing procedure may be repeated as many times as necessary until the entire filmstrip has been processed. It has been shown that reprocessing the portion of the filmstrip containing the initial exposures, at a latter time when the remaining frames are processed, has no significant effect on the quality of the resulting images.

The preferred method for enabling information exchange between camera and printer to facilitate partial-roll processing, is disclosed by the present assignee in U.S. Pat. No. 5,029,313 (Robison et al), and which is hereby incorporated by reference. Robison makes use of a virtually transparent magnetic layer provided as an additional layer on the film. Information exchange between various users of the film such as, for example, the film manufacturer, the camera user, the dealer and photofinisher, is carried via plural longitudinal magnetic tracks on the film. Each track is dedicated to the writing and reading of a predetermined set of parameters relating to the corresponding frame. The photofinisher-dedicated tracks fill the image-bearing area of each frame. The camera dedicated tracks lie along the edges of the film between the film perforations. Each track begins and ends within a single frame, and is divided into a plurality of fields.

Referring to the apparatus and method disclosed in Robison, and in particular to FIG. 7, it is apparent that a variety of data verifying the presence of a photographer-placed exposure is available. In facet, the presence of any camera-written information for a specific frame indicates that the frame has been exposed in the camera. During partial-roll processing, only those frames containing camera-written information, as measured in the included magnetic read-write apparatus (not shown), are loaded onto the processing reel 40.

It is to be understood that various other modifications or changes may be made to the present invention without departing from the scope of the present invention. The present invention is defined by the following claims.

Parts List

10 . . . apparatus
12 . . . load/unload station
14 . . . film processing section
16 . . . drying section
18 . . . housing
20 . . . elevator
22 . . . guide rods
24 . . . lift support plate
26,38 . . . openings
28 . . . cover assembly
29 . . . load/unload position
30 . . . plate
31 . . . processing unload position
32 . . . film support member
36 . . . cartridge feed mechanism
39 . . . thrust film cartridge
40 . . . reel
42 . . . reel support frame
44 . . . side members
46,58 . . . advance motor
48 . . . filmstrip
50 . . . motor
54,64,68 . . . opening
55 . . . flexible rollers
56,98,114,130 . . . motor

57 . . . spring member
59 . . . screw
60,94 . . . solenoid
61 . . . rotating cover
62 . . . projection
66 . . . mounting projection
70 . . . tongue portion
72 . . . processing position
74,76,78,80,82,84 . . . processing tanks
86 . . . transport mechanism
88,89 . . . bearing mounts
90 . . . linear bearing
92 . . . support bar
98,114,130 . . . motor
100 . . . gear train
101 . . . moisture seal
102 . . . gear
104 . . . drive shaft
106,108 . . . keys
110 . . . recess
112 . . . edge
116 . . . pulley/syncromesh cable
118 . . . bearing blocks
120 . . . motor bracket
122 . . . bearing
124 . . . collar
125 . . . ring
127,129 . . . point
128 . . . pulley
132 . . . propeller
134 . . . ridge
145 . . . wall
146 . . . lip
150 . . . shaft
152 . . . magnet
154,155 . . . bearings
156-161 . . . coils
162 . . . circuit board
232 . . . processing solution

We claim:

1. An apparatus for processing a filmstrip contained in a film cartridge, said filmstrip having a trailing end secured to the cartridge, said apparatus comprising:

at least one processing tank for holding a processing solution therein;

a holding mechanism for holding and retaining a film cartridge containing a filmstrip;

a film drive mechanism for moving the filmstrip out of or back into the film cartridge while the trailing end of the filmstrip remains attached to the cartridge; and a transport mechanism for moving said holding mechanism along said apparatus so that said holding mechanism can be located at a work station located adjacent said at least one processing tank, said holding mechanism includes a reel assembly for receiving and holding a portion of the filmstrip as it exits the film cartridge positioned at said work station, said reel assembly capable of being positioned within said at least one processing tank so that the filmstrip will be submerged within a processing solution contained in said at least one processing tank.

2. An apparatus according to claim 1 further comprising an agitation mechanism for agitating the processing solution contained in said tank and causing the processing solution to flow adjacent said filmstrip.

3. An apparatus according to claim 2 wherein said reel assembly includes a pair of spaced edge guides which are formed in a generally spiral pattern and spaced apart such that when the film is received within said edge guides, the surface of the filmstrip will not contact the adjacent convolution of the filmstrip.

4. An apparatus according to claim 1 wherein there is provided at least one development tank containing a development processing solution, at least one tank containing a bleach solution, at least one fix tank containing at least one fixing solution and at least one wash tank containing a washing solution.

5. An apparatus according to claim 1 wherein said drive mechanism includes a rail upon which said holding mechanism moves through said apparatus.

6. An apparatus according to claim 2 wherein said agitation mechanism comprises a propeller positioned adjacent said reel assembly when said reel assembly is positioned within the processing solution.

7. An apparatus according to claim 6 wherein said propeller is connected to a drive located outside of the tank by a magnetic coupler.

8. An apparatus according to claim 1 wherein said at least one processing tank has an access opening at the top of the tank and said holding mechanism includes a moisture seal for covering said access opening when said holding mechanism is positioned at said work station.

9. The method of processing a filmstrip while said filmstrip is still attached to a film cartridge, said filmstrip having a trailing end connected to the film cartridge, comprising the steps of:

providing a film cartridge having an filmstrip which is at least partially exposed therein;

providing at least one processing tank containing a processing solution;

providing a holding mechanism for holding a film cartridge;

moving the portion of the filmstrip that has been exposed out of the cartridge in to a holding device while the trailing end of the filmstrip is still attached to the cartridge;

providing a drive mechanism for moving said holding mechanism so that said holding mechanism can be located at said least one processing tank;

transporting said film cartridge through said apparatus and at least one of said tanks;

maintaining the filmstrip in the tank for a predetermined period of time; and removing the filmstrip from the processing solution.

10. A method according to claim 9 further comprising the step of rewinding the filmstrip back into the film cartridge after the filmstrip has completed its processing.

11. An apparatus for processing a filmstrip contained in a film cartridge, said apparatus comprising:

a plurality of processing tanks for holding a processing solution therein;

a holding mechanism for holding and retaining a film cartridge containing a filmstrip wound about a spool mounted in said film cartridge;

a transport mechanism for moving said holding mechanism along said apparatus so that said holding mechanism can be located at one of said plurality of processing tanks; and a film drive mechanism for moving the filmstrip out of or back into the film cartridge, said holding mechanism having a holding device for holding the filmstrip in a predetermined stable position.

12. An apparatus according to claim 11 wherein a plurality of holding mechanisms are provided and said transport mechanism moves each of the holding mechanisms sequentially through said apparatus.

13. The method of processing a filmstrip while said filmstrip is still attached to a film cartridge, comprising the steps of:

providing a thrust film cartridge having an exposed filmstrip therein, said filmstrip having a trailing end secured to the cartridge;

providing a plurality of processing tanks, each tank containing a processing solution;

providing a holding mechanism for holding a film thrust cartridge;

providing said holding mechanism with a reel assembly for receiving a filmstrip thrust out of said film cartridge in a predetermined position;

providing a transporting mechanism for moving said holding mechanism so that said holding mechanism can be located at each of said plurality of processing tanks;

moving the filmstrip out of the cartridge into the reel assembly;

transporting said film cartridge through said apparatus and stopping adjacent to at least one of said tanks;

placing the reel assembly into the processing solution contained in the adjacent tank;

maintaining the filmstrip in the adjacent tank for a predetermined period of time; and removing the filmstrip from the processing solution.

14. A method according to claim 13 further comprising the step of rewinding the filmstrip back into the film cartridge after the filmstrip has completed its processing.

15. A method of processing only the exposed portion of a film strip from a film cartridge still having an unexposed portion, comprising the steps of;

thrusting the film out of said cartridge an amount so that the exposed portion is disposed out of the cartridge and any remaining unexposed portion is substantially within the cartridge;

subjecting the exposed portion of the filmstrip to a photo developing process so as to develop the exposed portion; and rewinding the filmstrip back into to the cartridge so that the unexposed portion can be used.

16. The method according to claim 15 wherein the filmstrip has an additional exposed but not developed portion, developing the additional portion by:

thrusting the filmstrip out of said cartridge an amount so that the additional exposed portion is disposed out of the cartridge and any remaining unexposed portion is substantially within the cartridge;

subjecting the additional exposed portion of the filmstrip to a photo developing process so as to develop the additional exposed portion; and rewinding the filmstrip back into to the cartridge so that any remaining unexposed portion can be used.

17. An apparatus for processing a filmstrip contained in a film cartridge, said filmstrip having a trailing end secured to the cartridge, said apparatus comprising:

at least one processing tank for holding a processing solution therein;

a holding mechanism for holding and retaining a film cartridge containing a filmstrip;

a film drive mechanism for moving the filmstrip out of or back into the film cartridge while the trailing end of the filmstrip remains attached to the cartridge; and a transport mechanism for moving said holding mechanism along said apparatus so that said holding mechanism can be located at a work station located adjacent said at least one processing tank, said at least one processing tank has an access opening at the top of the tank and said holding mechanism includes a moisture seal covering said access opening when said holding mechanism is positioned at said work station.

* * * * *